United States Patent [19]

Hammonds et al.

[11] 4,397,594

[45] Aug. 9, 1983

[54] COLLAPSIBLE TRAILER HITCH BUMPER BLOCK ASSEMBLY

[75] Inventors: James C. Hammonds, St. Charles, Mo.; Patricia S. Stoller, Plymouth, Mich.; Ronald D. VanDyke, Florissant, Mo.

[73] Assignee: ACF Industries, Incorporated, New York, N.Y.

[21] Appl. No.: 155,708

[22] Filed: Jun. 2, 1980

Related U.S. Application Data

[63] Continuation-in-part of Ser. No. 8,300, Jan. 31, 1979, Pat. No. 4,239,429.

[51] Int. Cl.[3] ..... B60P 3/06; B61D 3/16; B61K 13/00; B62D 53/10

[52] U.S. Cl. ..... 410/59; 280/433; 410/64

[58] Field of Search ..... 280/433; 410/56, 57, 410/58, 59, 60, 61, 62, 63, 64, 65

[56] References Cited

U.S. PATENT DOCUMENTS

| | | | |
|---|---|---|---|
| 3,185,421 | 5/1965 | Ferris | 410/59 |
| 3,202,390 | 8/1965 | Sherrie et al. | 410/63 |
| 3,228,641 | 1/1966 | Ferris | 410/64 |
| 3,434,683 | 3/1969 | Rollins | 410/59 X |
| 3,493,207 | 2/1970 | Ferris et al. | 410/64 |
| 3,539,141 | 11/1970 | Mowatt-Larssen | 410/64 |
| 3,964,766 | 6/1976 | Ferris et al. | 280/433 |
| 4,239,429 | 12/1980 | Stroller et al. | 410/59 |

*Primary Examiner*—Joseph F. Peters, Jr.
*Assistant Examiner*—Howard Beltran
*Attorney, Agent, or Firm*—Henry W. Cummings

[57] ABSTRACT

A tractor operated hitch is provided including a vertical strut and a diagonal strut, each connected to the hitch head and which provide the sole support for the hitch head. A bumper block assembly is pivotably mounted about the hitch head which depends from and extends outwardly from the hitch head in a direction away from the diagonal strut a distance sufficient to locate a bumper within the industry standard distance above the deck. On the opposite side of its pivot point the bumper block assembly is connected to a diagonal strut linkage which, upon application of sufficient force by the tractor to the bumper, will pivot the bumper block assembly about its pivot point and disconnect the diagonal strut linkage from an upright, engaged position to a retracted position on the deck. The vertical strut is provided with a bumper block assembly slot located between transversely spaced vertical legs or in a transverse wall portion whereby in retracted position the hitch and the bumper block assembly do not extend more than six (6) inches above the deck. This allows other tractors and trailers to pass over the retracted hitch and complies with the industry standard concerning tractor operated hitches in the retracted position.

7 Claims, 23 Drawing Figures

COLLAPSIBLE TRAILER HITCH BUMPER BLOCK ASSEMBLY

REFERENCE TO RELATED APPLICATION

This application is a continuous-in-part of application Ser. No. 8,300 filed Jan. 31, 1979, now U.S. Pat. No. 4,239,429, granted Dec. 16, 1980.

BACKGROUND OF THE INVENTION

In present commercially marketed tractor operated hitches, a diagonal strut is pinned to a vertical strut and the vertical strut engages and supports a hitch head for holding a trailer kingpin in place on a railway flat car. A bumper block to be engaged by a tractor to collapse the hitch to a retracted position extends outwardly from the vertical strut in a direction away from the diagonal strut. However, connecting the diagonal strut to the vertical strut intermediate the length of the vertical strut introduces substantial bending loads into the vertical strut due to fore and aft movement of the trailer.

Because of these vending loads the vertical strut must be a heavy member, adding weight and expense to the hitch.

In one tractor operated hitch construction described in U.S. Pat. No. 3,202,390, the diagonal strut includes telescoping members held together by pins extending through the telescoping members. In order to collapse the hitch the operator manually removes the pins and then backs the tractor into the hitch until the hitch collapses. Thus the hitch is not truly automatic in that the operator must manually remove the pins prior to its collapse. In this regard this construction appears more dangerous than an automatic hitch knocked down by the tractor. Secondly, the hitch does not have a bumper block for the tractor to engage to collapse the hitch.

U.S. Pat. No. 3,228,641 discloses a tractor operated hitch in which a diagonal strut and a vertical strut are connected to the hitch head by two (2) common pins. However, the bumper block is connected to a separate vertical leg which is connected to the diagonal strut. This additional leg and its connections to the diagonal strut adds weight and expense to the hitch. Furthermore, the bumper block is located below the current industry standard covering the height of the bumper block, which requires the bumper block to be from 30 to 40 inches from the deck of the car.

If the diagonal strut and the vertical strut are both pinned to the hitch head, a problem exists as to how to mount the bumper block assembly on the hitch to comply with the industry standard concerning the height of the bumper block assembly in the upright position, and at the same time locate the bumper block assembly on the hitch such that when the hitch is in the retracted position on the deck, the bumper deck assembly does not project above the remainder of the hitch and thus complies with another industry standard which requires that no part of the hitch in the retracted position extend more than six (6) inches above the deck.

In U.S. Pat. No. 3,964,766, a trailer hitch is disclosed in which the vertical strut and the diagonal strut are both connected to the hitch head. However, in the description of the preferred embodiments, this patent refers to U.S. Pat. No. 3,493,207 for a description of collapsing the hitch to the deck of the car. This latter patent discloses a hitch in which the diagonal strut is pinned to the vertical strut rather than to the head. Therefore, U.S. Pat. No. 3,964,766 does not clearly teach tractor operation of a hitch in which the vertical strut and diagonal strut are connected to the hitch head and the operation thereof is clearly spelled out.

SUMMARY OF THE INVENTION

One object of the present invention is to provide a tractor operated hitch wherein bending loads resulting from the fore and aft movement of trailer are substantially reduced or eliminated from the vertical strut, and thereby reduce the weight and cost of the vertical strut.

Another object is to provide a tractor operated hitch in which the bumper block assembly is located on the hitch such that when the hitch is in upright position the bumper block is located from 30 to 40 inches above the deck, and when the hitch is in the retracted position, the bumper block assembly does not extend more than six (6) inches above the deck.

In accordance with the present invention a tractor operated hitch is provided including a vertical strut and a diagonal strut, each connected to the hitch head and which provides the sole support for the hitch head. A bumper block assembly is pivotably mounted about the hitch head which depends from and extends outwardly from the hitch head in a direction away from the diagonal strut a distance sufficient to locate a bumper within the industry standard proscribed distance above the deck. On the opposite side of its pivot point the bumper block assembly is connected to a diagonal strut linkage which, upon application of sufficient force by the tractor to the bumper, will pivot the bumper block assembly about its pivot point and disconnect the diagonal strut linkage from an upright, engaged position to a disengaged position. The hitch than falls, at least partially by gravity, to a retracted position on the deck. The vertical strut is provided with a bumper block assembly slot located between transversely spaced vertical legs or in a transverse wall portion whereby in retracted position the hitch and the bumper block assembly do not extend more than six (6) inches above the deck. This allows other tractors and trailers to pass over the retracted hitch, and complies with the industry standard concerning tractor operated hitches in the retracted position.

THE DRAWINGS

DESCRIPTION OF PREFERRED EMBODIMENTS

Figures 1, 1A, 17:
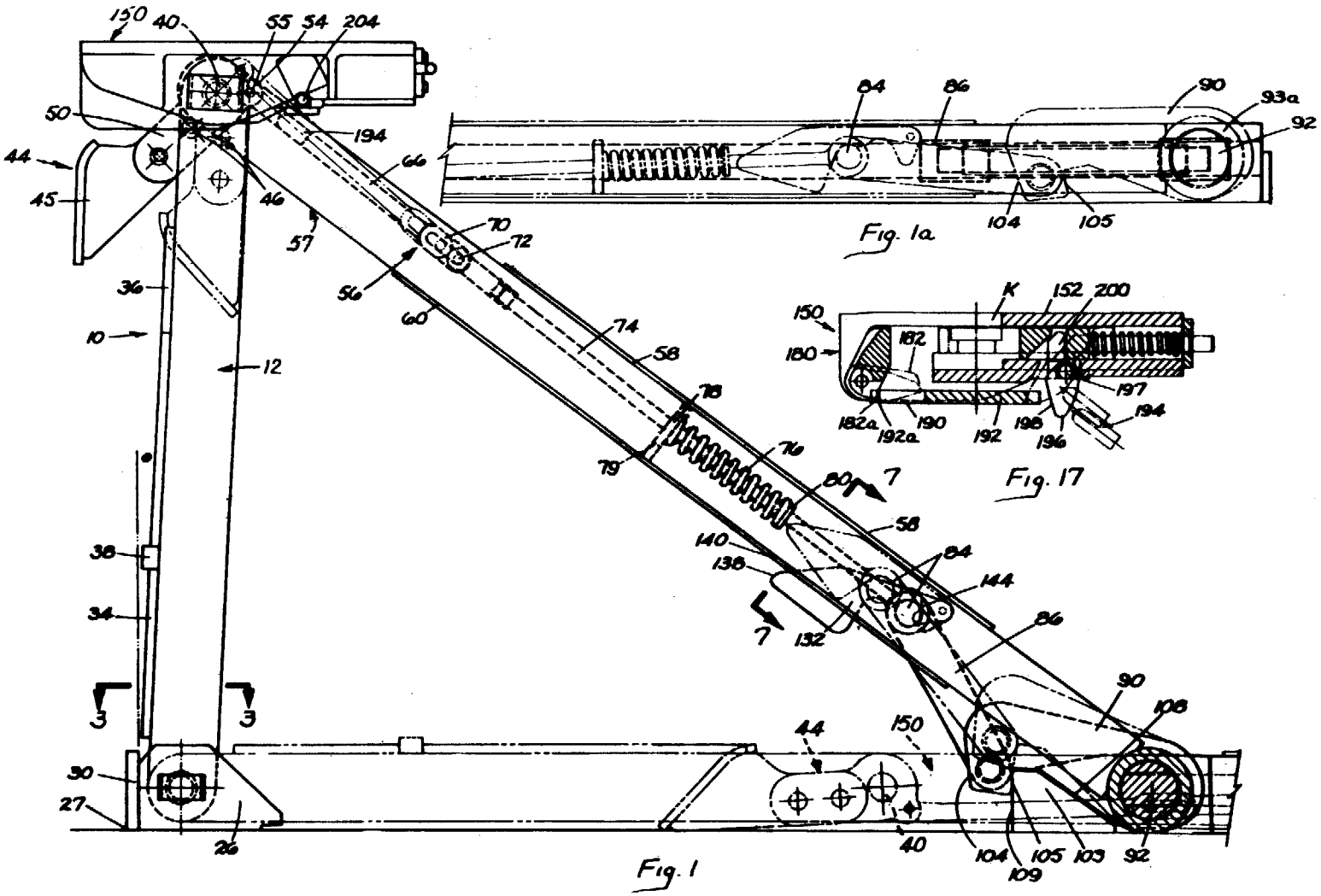
FIG. 1 is a vertical side elevation view of the trailer hitch of the present invention.
FIG. 1A is a vertical side elevation view and a continuation of the right hand portion of FIG. 1.
FIG. 17 is a vertical sectional view looking in the direction of the arrows along the line 17—17 in FIG. 8.
Figures 2, 3, 4, 5, 6, 7, 9, 10, 11, 12, 13, 20, 21:
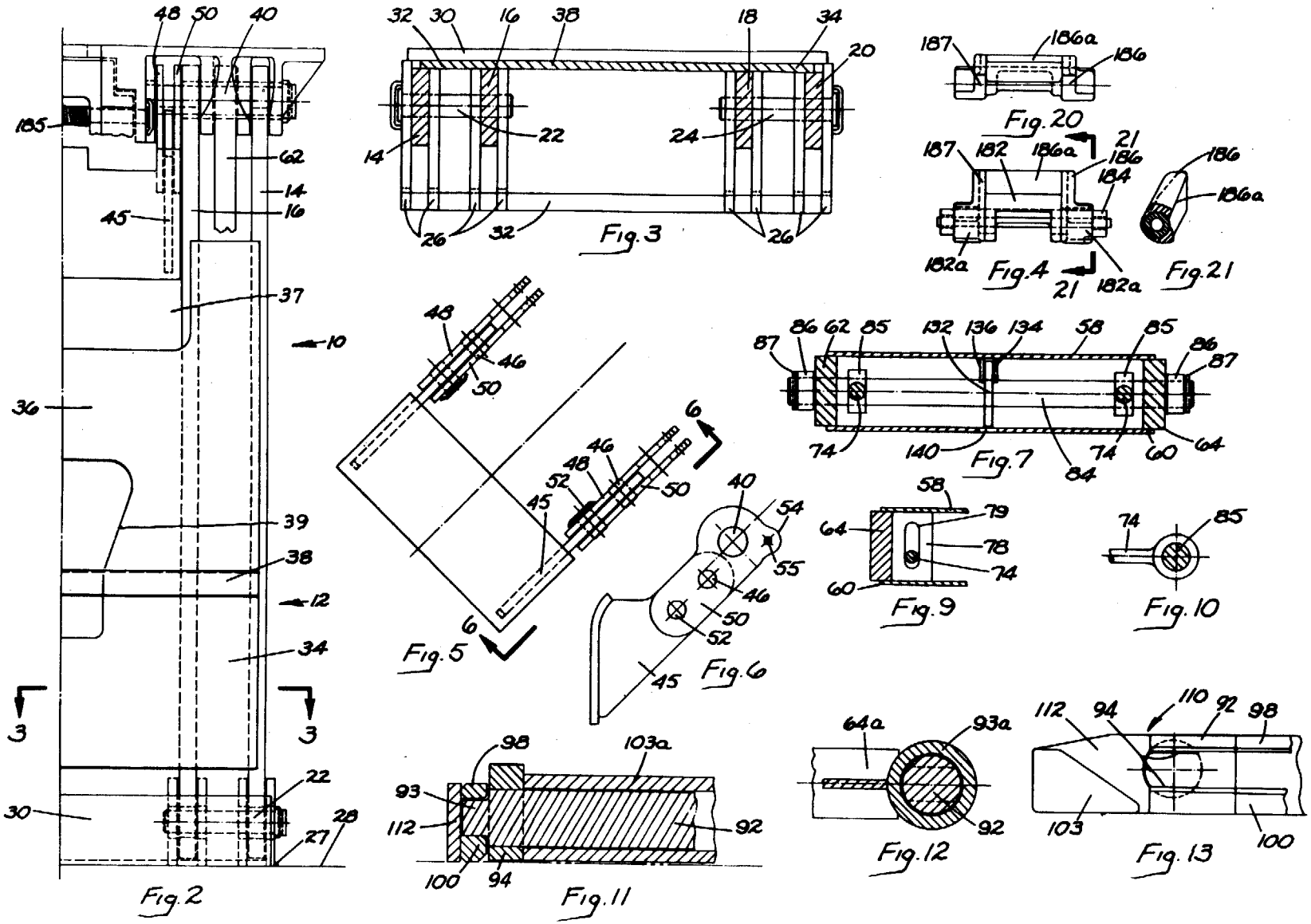
FIG. 2 is a partial vertical end view of the trailer hitch of the present invention.
FIG. 3 is a horizontal sectional view looking in the direction of the arrow along the line 3—3 in FIGS. 1 and 2.
FIG. 4 is a detail view of the one-way gate in the hitch head.
FIG. 5 is a detail plan view of the bumper bar assembly.
FIG. 6 is a side elevation view of the bumper bar assembly shown in FIG. 5.
FIG. 7 is a sectional view looking in the direction of the arrows along the line 7—7 in FIG. 1.
FIG. 9 is a sectional view looking in the direction of the arrows along the line 9—9 in FIG. 8.
FIG. 10 is a sectional view looking in the direction of the arrows along the line 10—10 in FIG. 16.
FIG. 11 is a vertical sectional view looking in the direction of the arrows along the line 11—11 in FIG. 16.
FIG. 12 is a vertical sectional view looking in the direction of the arrows along the line 12—12 in FIG. 16.
FIG. 13 is a side elevation view looking in the direction of the arrows along the line 13—13 in FIG. 8.
FIG. 20 is a plan view of the one-way gate illustrated in FIG. 4.
FIG. 21 is an end elevation view partly in section looking in the direction of the arrows along the line 21—21 in FIG. 4.

The trailer hitch of the present invention is indicated in the drawings generally at 10. The hitch includes a vertical strut indicated at 12 which may be of relatively light weight construction because, in accordance with the invention, bending loads are substantially reduced or eliminated in this construction. The vertical strut includes four vertical plates 14, 16, 18 and 20 (FIG. 3). The plates extend vertically from a pair of pivot pins 22 and 24, passing through the plates and through base lugs 26 welded at 27 to the car deck 28. In addition, tie plates 30 and 32 extend along the front and back of lugs 26 parallel to pivot pins 22 and 24. Transverse end plates 34 and 36 are welded to vertical plates 14, 16, 18 and 20 and extend along the end of the hitch as shown in FIGS. 1 and 2. Plate 36 is cut away at it upper portion to define a bumper block assembly slot 37.

A lifting bar 38 is provided transversely of the hitch to be used in raising the hitch to upright position as will be described hereinafter.

Another slot 39 is provided in plate 36 to provide ease of attachment of the hitch lifting mechanism to the bar 38.

It is to be noted from FIG. 1, angle 0, that vertical strut 12 is inclined with respect to the vertical from one (1) to five (5) degrees to ensure that the hitch will pivot from left to right in FIG. 1 to assume the retracted position to be described hereinafter.

Vertical strut plates 14, 16, 18 and 20 at their upper ends are pivoted about upper pivot pins 40 located in the hitch head 150. In accordance with another feature of the present invention, pivoted about pin 40 is a bumper block assembly 44. As shown in FIGS. 5 and 6, bumper block assembly 44 includes bumper block 45 and bumper block supports 48 and 50 depending from and pivoted about a pivot pin 46. In addition, a separate pin 52 extending between bumper block supports 48 and 50 and bumper block 45 is provided. If too great a bumper force is applied by the tractor, allowing bumper block 45 to pivot about pin 40, pins 52 will shear off, thereby avoiding damaging the remaining parts of the operating linkage of the hitch. It is a simple matter to replace pins 52, and replace bumper block 45 into the position shown in FIGS. 1, 5 and 6.

As an example, pins 52 may be designed to shear at a bumper block load of 10,000 pounds or higher. To achieve this shearing capability, pins 52 may be made of carbon steel, such as ASTM 5766, Grade 160, and have a diameter of 1.010 ±0.005 inches, having a tensile strength of 135,000-140,000 psi or a shear strength of 81,000-84,000 psi. Different size pins may be used and grooves formed in the pins to ensure that the pins will shear at the desired applied load.

On either side of the hitch, transversely spaced connecting lugs 54 are provided on bumper block supports 48 and 50. A diagonal strut linkage indicated generally at 56 is attached to respective connecting lugs 54. Pins 55 connect bars 66 and 68 to lugs 54 (FIGS. 1 and 6).

In accordance with another feature of the present invention, the diagonal strut 57 is connected to the hitch head 150 and is pivoted about pins 40. This substantially reduces or eliminates bending loads in vertical strut 12.

As shown in FIGS. 1 and 7, the diagonal strut 57 includes upper cover plates 58, lower cover plate 60, and transversely spaced diagonal strut side plates 62 and 64. The side plates 62 and 64 are pivotably mounted about pins 40 as shown in FIGS. 2 and 8.

In the diagonal strut linkage 56, bars 66 and 68 are each attached to a clevis 70 with a clevis pin 72 (FIGS. 1 and 2). Rods 74 are threaded into the opposite ends of each of the clevises 70. A compression spring 76 surrounds each of the rods 74, held in place with a first spring plate 78 attached to cover plates 60, and a second spring plate 80 attached to rod 74 with a pin 82. A similar clevis and spring arrangement is provided for bar 66 on the other side of the diagonal strut. As shown in FIG. 9, rods 74 are vertically movable within a slot 79 provided in plate 78.

Rods 74 are attached to a shaft 84 with a slip fit as indicated in FIG. 10 at 85. At opposite ends of shaft 84, connecting links 86 are located outboard of diagonal strut plates 62 and 64 (FIG. 7), held in place respectively with fasteners 87. Each of the connecting links 86 include an opening 88 (FIG. 16). Sidewalls 62 and 64 include lower extensions 64*a* one of which is indicated in FIGS. 12 and 16.

Figures 8, 14, 15, 16, 16A, 18, 19:
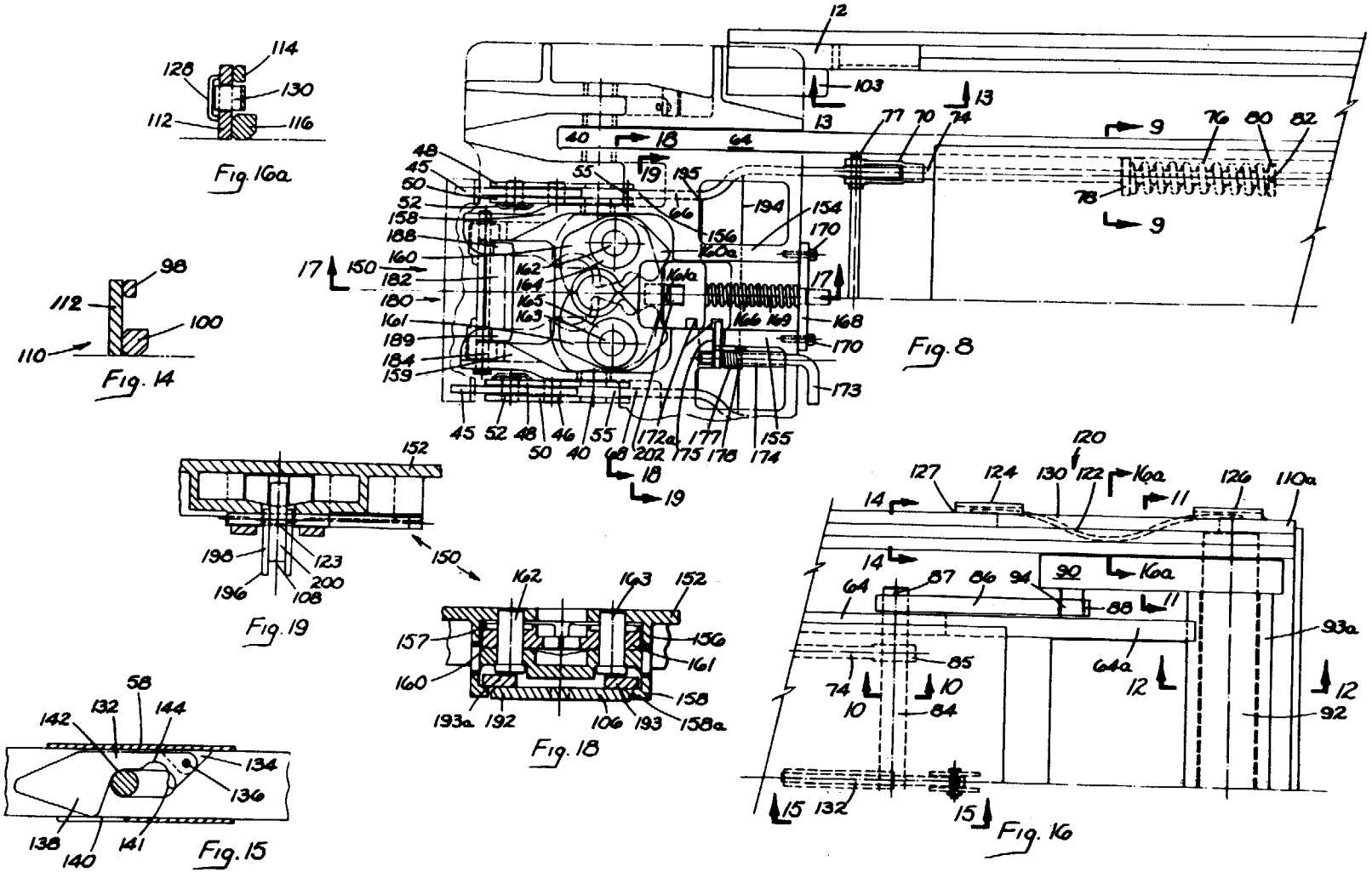
FIG. 8 is a partial plan view including the hitch head and the diagonal strut of the trailer hitch of the present invention.
FIG. 14 is a vertical sectional view looking in the direction of the arrows along the line 14—14 in FIG. 16.
FIG. 15 is an enlarged detail view of the indicating member assembly looking in the direction of the arrows along the line 15—15 in FIG. 16.
FIG. 16 is a plan view of the lower right hand portion of FIG. 8 illustrating a resilient device to retard movement of the hitch to the retracted position.
FIG. 16A is a sectional view looking in the direction of the arrows along the line 16A—16A in FIG. 16.
FIG. 18 is a vertical sectional view looking in the direction of the arrows along the line 18—18 in FIG. 8.
FIG. 19 is a vertical sectional view looking in the direction of the arrows along the line 19—19 in FIG. 8.

A pair of transversely spaced movable locking lugs or hooks 90 are pivotally mounted about a diagonal strut pivot pin 92 (FIGS. 1 and 8). Movable locking lugs 90 include lateral projections 94 which are inserted into opening 88 in links 86 (FIG. 8). As shown in FIG. 11, the opposite ends 93 of diagonal strut pivot pin 92 are located within vertically spaced guides 98 and 100, each in turn welded to vertical plate 112. Pivot pin 92 is mounted within a tube 93*a* (FIG. 12) within which pivot pin 92 rotates. Furthermore, as shown in FIG. 13, portions 94 of shaft 92 are cut off to fit within guides 98 and 100. FIG. 13 also shows a fixed locking lug 103 welded to the deck to which is attached vertical plate 112.

Movable locking lugs 90 include a cam surface (FIG. 1) 104 and a locking surface 105. Fixed locking lug 103 includes a cooperating cam surface 108 and a cooperating locking surface 109. When the hitch is moved into the upright position when the tractor engages lifting bar 38, the movable locking lug cam surface 104 moves along fixed locking lug cam surface 108 and then drops into the locked position with locking surfaces 105 and 109 abutting as shown in FIG. 1 in solid lines.

As shown in FIGS. 13 and 14, retracted position guides indicated generally at 110 include vertically extending plate 112 welded to the car deck and to horizontally extending, vertically spaced guides 98 and 100. It will be apparent that when the tractor contacts bumper block 45 and pivots lug 54 about pin 40, as shown in dotted lines in FIG. 1, bumper block assembly 44 and diagonal strut rods 66 and 68 are moved counter-clockwise and upwardly. This lifts rods 74, shaft 84, and links 86 upwardly from right to left in FIGS. 1 and 8. This in turn moves movable locking lugs 90 vertically and clockwise about pivot pin 92, as also shown dotted in FIG. 1. When this occurs, due to the inclination of the vertical strut about pivot pins 22 and 24, the entire hitch moves downwardly from left to right with the end portions 93 of shaft 92 following the guide assembly to the end portions 110*a* of deck guide portions 110. FIG. 1 shows the pivot shaft 92 and the movable locking lug 90 in the upright position in solid lines, and FIGS. 1 and 1A show the hitch in the retracted position in phantom lines.

In accordance with another feature of the present invention in retracted position, bumper block assembly is located within vertical strut 12, in bumper block assembly slot 37, outwardly from hitch head 150. In retracted position hitch 10 and bumper block assembly 44 do not extend above the deck in excess of six (6) inches. This complies with industry standard for tractor operated hitches in the retracted position and allows tractors and trailers to pass over the hitch to load or unload other cars.

An indicator 132 is pivotally mounted about cover plate 58 by means of a pair of brackets 134 and a pivot pin 136 extending therebetween (FIGS. 1, 7 and 15). The lower portion 138 of the indicator is movable within a slot 140 within bottom cover plate 60. The word "LOCKED" is printed upon the lower portion 138 (FIG. 1). Indicator 132 includes a slot 141 and a lower surface 142. Shaft 84 engages a camming surface 144 in slot 141. Indicator 132 then pivots by gravity and/or engagement of shaft 84 with camming surface 144 about pivot pin 136, whereby indicator 132 again moves outwardly through slot 140 to indicate that the hitch is now locked in the upright position, and the words "LOCKED" are again viewable as shown in FIG. 1.

Compression spring 76 biases movable locking lug 90 into the upright locked position engaging fixed locking lug 106. Thus, the tractor engaging bumper bar 44 must overcome the bias of spring 76 when connecting lug 54 is rotated counter-clockwise about pin 40. When connecting lug 54 pulls rods 66 and 68 upwardly, and counter-clockwise, shaft 84 is lifted and moved from righ to left. This necessitates relative vertical movement between rod 74 and shafts 66 and 68. This is accomplished by clevis rod 74 moving vertically within slot 79 as shown in FIG. 9.

To retard the movement of the hitch to retracted position, a spring assembly indicated generally at 120 is optionally provided. As shown in FIGS. 1 and 16, this spring assembly includes a leaf spring 122, attached with leaf spring holders 124 and 126 to vertical guide member 112. Leaf spring holders may be attached to guide member 112 by welding as shown at 127, or with fasteners. A keeper 128 is welded to vertical guide 112 and a slot 130 is provided in vertical guide 112. The end portions 93 (FIG. 11) of the pin 92 contact leaf spring 122 and depress the same and move it laterally as the spring retards the movement of the hitch as it assumes the retracted position. Since pin 92 is beyond spring 122 in its fully retracted position, it does not interfere with the complete retraction of the hitch.

When bumper bar assembly 44 is rotated and pivots lug 54 about pin 40, and diagonal strut rods 66 and 68 are moved counter-clockwise and from left to right in FIG. 1, rods 74 and shaft 84 are moved upwardly, and shaft 84 moves into engagement with the lower surface 142 of indicator 132. This pivots indicator 132 about pivot pin 136 and end portion 138 moves upwardly through slot 140 and into diagonal strut 56. Indicating member 132 remains within the doagonal strut in the position shown in FIG. 15 throughout the time that the hitch is in the retracted position.

When the hitch is moved from right to left in FIG. 1, with the tractor engaging lifting bar 38, the diagonal strut moves from right to left in FIG. 1 until surface 104 on movable locking lug 90 drops vertically and surface 105 engages the locking surface 109 on fixed lug 103. Links 86 then assume the position shown in solid lines. Shaft 84 engages indicator 138 at 141 to pivot the same from the position shown in dotted lines in FIG. 1 to the position shown in solid lines.

The hitch head is indicated in the drawings generally at 150 in FIGS. 8, 18 and 19. The head includes a top plate 152 and a pair of rear head portions 154 and 155. A pair of vertical webs 156 and 157 extend forwardly to gate connecting portions 158 and 159. A pair of jaws 160 and 161 are pivotally mounted about a pair of shafts 162 and 163 (FIGS. 8 and 18). Torsion springs 164 and 165 bias the jaws 160 and 161 to the open position. A stiff spring 166 is attached to a locking member 172 by means of a plate 168 and spring shaft 169. Fasteners 170 hold plate 168 attached to rear head portions 154 and 155. Spring 166 biases locking member 172 into the forward position which engages jaws 160 and 161, and holds the jaws in closed position in engagement with a kingpin K (FIG. 17).

When the locking member 172 is moved from left to right in FIG. 8, the jaws 160 and 161 open and the kingpin can be removed. Locking member 172 includes a slot 172*a*, and a handle 173 extends into an opening 174 in head portion 155. A torsion spring 177 held in place with a pin 178 biases keeper 175 out of engagement with slot 172*a*. However, handle 173 may be manually rotated to move keeper 175 into engagement with slot 172*a*, as shown dotted in FIG. 8, and hold locking member 172 out of engagement with jaws 160 and 161 to allow exit of kingpin K from jaws 160 and 161. In the absence of locking member 172 and spring 166, torsion springs 163 and 164 bias the jaws to the open position. However, if the kingpin is in the place, the kingpin prevents the complete opening of the jaws.

Jaws 160 and 161 each include rear lug portions 160*a* and 161*a*. When the kingpin exits from the head, the head, the lug portions 160*a* and 161*a* engage locking member 172 and move it from left to right in FIG. 2 a distance sufficient for keeper 175 to pivot out of slot 176 under the bias of torsion spring 177. Thus, locking member 172 assumes a position engaging the rear jaw lugs 160*a*, 161*a*; holding jaws 160 and 161 in open position as shown in dotted lines in FIG. 8, ready to receive another kingpin.

A one-way gate indicated generally at 180 includes a gate member 182 pivotally mounted about a gate shaft 184. Shaft 184 is rotatably mounted on gate connecting portions 158 and 159. A torsion spring 185 (FIG. 2) biases gate member 182 into the generally vertical position shown in FIG. 17. As shown in FIGS. 4, 20 and 21, a transverse web 186*a* connects stop portions 186 and 187. Stop portions 186 and 187 of gate member 182 engage web portions 188 and 189 of gate connecting portions 158 and 159 to prevent movement of the one-way gate in a counter-clockwise direction (FIG. 8). However, gate member 182 is capable of clockwise movement about shaft 184 in FIG. 17, and a slot 190 is provided in one-way gate actuating plate 192 for gate 182 to pass through.

A head actuator 194 is rigidly connected to rods 66 and 68 by welding as indicated at 195 (FIG. 8) or with fasteners. Actuator 194 is adapted to engage one-way gate links 196. Links 196 are free to pivot about a shaft 197. Links 196 each include a cam surface 198 which engages actuating plate 192 (FIG. 17). A second actuator link 200 is secure to shaft 197 and extends upwardly through a slot 202 in locking member 172.

As shown in FIG. 18, head portion 158 includes horizontal extensions 158*a* upon which projections 193 and 193*a* welded to actuating plate 192 ride in moving longitudinally relative to the head between engaged and disengaged positions with one-way gate 182. Projections 193 and 193*a* support vertical pins 162 and 163 and are of sufficient length that when the actuating plate 192 is in the forward, engaged position in FIGS. 4 and 14, pins 162 and 163 are nonetheless supported.

It is thus apparent that, when bumper block 45 is actuated by a tractor and bumper block assembly 44 and link 54 are pivoted about pins 40 counter-clockwise, in addition to rods 66 and 68 moving upwardly, head actuator 194 also moves upwardly and engages link 196, pivoting the same about shaft 197. This causes cam surfaces 198 to engage gate actuating plate 192, moving plate 192 from right to left in FIG. 17, whereby end 192*a* engages gate member 182 at 182*a* and gate 182 is pivoted about shaft 184 through slot 190 so that the kingpin of a trailer may move from right to left in FIGS. 1, 8 and 17. Furthermore, link 200 moves locking member 172 from left to right against the bias of stiff spring 166 to the position shown in dotted lines in FIG. 8 which enables the jaws 160 to pivot about the shafts 162, 163 under the bias of torsion springs 164 and 165 as discussed hereinabove, and assume the open position. Thus, activation of the bumper bar assembly 44 by a tractor not only causes movement of the hitch from the extended operational position to the retracted position, but also one-way gate 180 is moved to the open position to allow removal of the kingpin, and locking member 172 is moved to the open position to allow the jaws to move to the open position to disengage the kingpin.

Shaft 197, at its outer end (FIG. 1), includes a connection portion 204, for example, of hexagon shape. Connection portion 204 is adapted to receive a suitable tool to pivot link 200, which is rigidly attached to shaft 197. Link 200 moves locking member 172 from left to right against the bias of spring 166 to enable torsion springs 164 to open jaws 160. It will be apparent that this manual operation does not require contact with head actuator 194. Manual unlocking of the kingpin is possible when the hitch is in the upright position, particularly for crane-operated, vertical unloading.

It is to be noted that actuation of shaft 197 in this manner does not activate one-way gate 182 because links 186 are free to rotate on shaft 197. Thus, even if locking member 172 is opened to allow jaws 160 and 161 to open for crane unloading, one-way gate 182 remains in place as a secondary lock.

What is claimed is:

1. A tractor operated hitch comprising: a vertical strut and a diagonal strut, each connected to a hitch head and which provide the sole support for the hitch head; a bumper block assembly pivotably mounted about the hitch head; said bumper block assembly including a bumper block depending from and extending outwardly from said hitch head in a direction away from said diagonal strut a distance sufficient to be engaged by a tractor used to load and unload trailers; said bumper block assembly connected on the opposite side of its pivot point to a diagonal strut linkage, where upon application of sufficient force by the tractor to said bumper block; said bumper block assembly will pivot about its pivot point and disconnect said diagonal strut linkage from an engaged position to a disengaged position with at least one fixed lug located adjacent said diagonal strut, whereby the hitch falls, at least partially by gravity, to retracted position on a deck; said vertical strut having a bumper block assembly slot located below said hitch head; said bumper block assembly located within said slot in retracted position; whereby in retracted position said bumper block assembly is positioned between the deck and the standard height above the deck.

2. A tractor operated hitch according to claim 1, wherein said bumper block assembly slot is located between transversely spaced vertical legs.

3. A tractor operated hitch according to claim 2, wherin said bumper block assembly is located within the confines of said vertical strut in retracted position.

4. A tractor operated hitch comprising: a vertical strut means connected to pivot pin means located in a hitch head; a diagonal strut connected to said pivot pin means; said vertical strut and said diagonal strut providing the sole support for the hitch head where vertical strut loads due to fore and aft movement of a trailer extend downwardly through said vertical strut substantially along the axis of said vertical strut to substantially eliminate bending loads in said vertical strut; a bumper block assembly pivotally mounted about the hitch head; said bumper block assembly depending from and extending outwardly from said hitch head in direction away from said diagonal strut a distance sufficient to be engaged by a tractor used to load and unload trailers; said bumper block assembly connected on the opposite side of its pivot point to a diagonal strut linkage, whereby upon application of sufficient force by the tractor to said bumper, said bumper block assembly will pivot about its pivot point and disconnect said diagonal strut linkage from an engaged position with at least one fixed lug located adjacent said diagonal strut to a disengaged position, whereby the hitch falls at least partially by gravity to a retracted position on a deck.

5. A tractor operated hitch according to claim 4, wherein said vertical strut is made of lighter material than would be the case if the vertical strut were carrying said bending loads.

6. A tractor operated hitch according to claim 4, wherein said vertical strut includes a bumper block slot, and wherein said bumper block assembly is located within said slot in retracted position; whereby in retracted position the hitch and the bumper block assembly is positioned between the deck and the standard height above the deck.

7. A tractor operated hitch according to claim 6, wherein a lifting bar is provided on said vertical strut engageable by a tractor to lift said hitch to a vertical operative position.

* * * * *